US007108058B2

(12) United States Patent
Pippert

(10) Patent No.: US 7,108,058 B2
(45) Date of Patent: Sep. 19, 2006

(54) PACKING ASSEMBLY FOR ROTARY DRILLING SWIVELS AND PUMPS HAVING ROTATING SHAFTS

(75) Inventor: Frederick B. Pippert, Sugar Land, TX (US)

(73) Assignee: Utex Industries, Inc., Houston, TX (US)

( * ) Notice: Subject to any disclaimer, the term of this patent is extended or adjusted under 35 U.S.C. 154(b) by 153 days.

(21) Appl. No.: 10/441,873

(22) Filed: May 20, 2003

(65) Prior Publication Data

US 2004/0035574 A1 Feb. 26, 2004

Related U.S. Application Data

(63) Continuation-in-part of application No. PCT/US02/18500, filed on Jun. 11, 2002.

(60) Provisional application No. 60/297,559, filed on Jun. 12, 2001.

(51) Int. Cl.
*E21B 19/24* (2006.01)
*F16J 15/20* (2006.01)

(52) U.S. Cl. ..... 166/84.4; 166/84.3; 277/516; 277/532

(58) Field of Classification Search ..... 166/381, 166/382, 75.11, 85.1, 85.3, 86.1, 86.2, 88.1, 166/88.2, 88.3, 82.1, 84.1, 84.2, 84.3, 84.4, 166/84.5, 106; 277/512, 516, 530, 532
See application file for complete search history.

(56) References Cited

U.S. PATENT DOCUMENTS 2,027,653 A * 1/1936 Roye ..... 285/94
2,150,529 A * 3/1939 Guglielmo ..... 277/329
2,210,826 A * 8/1940 Williams ..... 277/512
2,238,654 A * 4/1941 Maier ..... 277/329
2,459,472 A 1/1949 Tremolada
2,864,631 A * 12/1958 Kemp ..... 277/346
3,282,594 A * 11/1966 Wheeler ..... 277/575
3,719,366 A 3/1973 Pippert
3,781,456 A * 12/1973 Knowles et al. ..... 174/23 R
3,907,307 A * 9/1975 Maurer et al. ..... 277/513
3,948,588 A 4/1976 Curington et al.
4,004,433 A * 1/1977 Calistrat ..... 464/16
4,090,565 A * 5/1978 McGee ..... 166/379
4,130,287 A * 12/1978 Ritzie ..... 277/361
4,150,727 A 4/1979 Shepherd
4,177,998 A * 12/1979 Laitkep et al. ..... 277/513
4,328,974 A 5/1982 White et al.

(Continued)

OTHER PUBLICATIONS

Exhibit A—Catalog page depicting Skinner Bros. Co., Inc.'s Stuffing Boxes.

(Continued)

*Primary Examiner*—Jennifer H. Gay
(74) *Attorney, Agent, or Firm*—C. James Bushman; Browning Bushman P.C.

(57) ABSTRACT

A packing assembly for use with a rotary drilling swivel having a cylindrical wash pipe comprising a housing assembly including a packing gland forming a sealing assembly chamber around the wash pipe, the packing gland including an injection port in open communication with the chamber, a sealing assembly disposed in the chamber and including a first annular seal ring surrounding and in sealing engagement with the wash pipe, an annular containment member disposed in the chamber in surrounding relation to the wash pipe and axially spaced from the first seal ring and an injectable packing composition in sealing engagement with the wash pipe and disposed between the first seal ring and the containment member, one of the wash pipe and the packing assembly being rotatable relative to the other.

7 Claims, 5 Drawing Sheets

U.S. PATENT DOCUMENTS

| | | | | | |
|---|---|---|---|---|---|
| 4,364,542 | A | * | 12/1982 | Meyer | 251/214 |
| 4,384,726 | A | | 5/1983 | Meyer | |
| 4,390,063 | A | * | 6/1983 | Wells, Jr. | 166/84.5 |
| 4,430,892 | A | | 2/1984 | Owings | |
| 4,449,596 | A | | 5/1984 | Boyadjieff | |
| 4,451,047 | A | * | 5/1984 | Herd et al. | 277/539 |
| 4,572,519 | A | * | 2/1986 | Cameron et al. | 277/512 |
| 4,596,395 | A | * | 6/1986 | Miser | 277/562 |
| 4,936,382 | A | * | 6/1990 | Thomas | 166/88.2 |
| 5,135,240 | A | | 8/1992 | Dodson | |
| 5,137,083 | A | * | 8/1992 | Bump | 166/84.2 |
| 5,217,068 | A | * | 6/1993 | Newton | 166/84.2 |
| 5,284,084 | A | | 2/1994 | Pippert et al. | |
| 5,480,163 | A | | 1/1996 | Miser et al. | |
| 5,588,491 | A | * | 12/1996 | Brugman et al. | 166/383 |
| 5,791,411 | A | * | 8/1998 | Ricalton et al. | 166/84.1 |
| 5,823,541 | A | | 10/1998 | Dietle et al. | |
| 5,960,700 | A | | 10/1999 | Staggs et al. | |
| 6,007,105 | A | | 12/1999 | Dietle et al. | |
| 6,520,253 | B1 | * | 2/2003 | Calder | 166/84.4 |
| 6,843,313 | B1 | * | 1/2005 | Hult | 166/78.1 |

OTHER PUBLICATIONS

Exhibit B—Catalog page exhibiting J.M. Huber Corporation's Stuffing Boxes.
Exhibit C—Catalog page depicting Prior Art Double Packed Polished Rod Stuffing Box.
Exhibit D—Catalog page depicting Lubrikup Company, Inc.'s Packings for all Polished Rod Stuffing Boxes, etc.
Exhibit E—Prior Art Stuffing Box Gland and Seal.
Exhibit F—Prior Art Basic Stuffing Box.
Exhibit G—Prior Art Stuffing Box.
Exhibit H—Utex drawing illustrating Pump Packing Design.
Exhibit I—Utex drawing exhibiting High Pressure Packing.
Exhibit J—Utex drawing exhibiting High Pressure Swivel Packing.
Exhibit K—Utex drawing exhibiting Valve Stem Packing.
Exhibit L—Utex drawing exhibiting Live-Loaded Valve Packing Assembly.
Exhibit M—Illustrating a Prior Art Swivel.
Utex Industries, Inc. U-Pack—Brochure No. 001-03410-98/1M.

* cited by examiner

PACKING ASSEMBLY FOR ROTARY DRILLING SWIVELS AND PUMPS HAVING ROTATING SHAFTS

CROSS REFERENCE TO RELATED APPLICATIONS

This is a continuation-in-part of and claims priority from PCT Application PCT/US02/18500 filed Jun. 11, 2002, which claims priority from Provisional Application 60/297,559 filed Jun. 12, 2001, the disclosure all of all of which are incorporated herein by reference for all purposes.

BACKGROUND OF THE INVENTION

1. Field of the Invention

The present invention relates to packing assemblies for use in effecting fluid sealing around the wash pipe of a rotary drilling swivel and to such an assembly for effecting sealing around a rotating shaft of a pump.

2. Description of the Prior Art

In the drilling of oil and gas wells, a drill bit is rotated in a borehole by means of a string of drill pipe. The drill pipe is rotated on the surface mechanically by a rotating table mounted on a drilling platform or by a hydraulic motor, commonly referred to as a top drive. As is common in such oil and gas well drilling, drilling fluid or mud is circulated through the drill pipe and the drill bit to cool the drill bit and remove the cuttings, which are then recirculated to the surface and removed from the drilling fluid so it can be reused. Particularly in the case of deep wells, the drilling fluid can be at pressures that can range to several thousand psi.

The rotary drilling swivel commonly used in the drilling of oil and gas wells provides rotating support for the drill string suspended from it and a sealed passageway for circulating drilling fluids into the drill string. The drill pipe is in open-flow communication with a wash pipe, through which the drilling fluid flows, the wash pipe usually being stationary. A packing assembly forming part of the swivel rotates with the drill pipe, and is in scaling engagement with the wash pipe to prevent loss of drilling fluid out of the swivel assembly.

As noted above, depending on the depth of the well and/or well condition, drilling fluid pressure can reach several thousand psi, and at these high pressures, conventional, prior art packing assemblies used to seal between the wash pipe and the rotary head to which the drill pipe is secured have reduced life, resulting in leaking. Additionally, in top drive applications wherein the swivel assembly is rotating at a height of from 50 to 60 feet above the rig floor during drilling, it is difficult to maintain or adjust the packing or to add lubrication to the packing. Accordingly, only periodically, and typically only once a day, will the drilling operation be stopped to allow some adjustment to the rotating packing assembly and/or the addition of lubricant, which can be added through a grease port in the portion of the gland of the packing assembly that contains the seal rings.

Pumps employing rotary shafts, e.g., centrifugal pumps, generally employ lip types seals that are generally in a stacked configuration and employ various types of spacers or back-up rings, an adjustable gland being used to force the lips of the seals into engagement with the stuffing box or the like in which the seals are carried and the rotating shaft that extends through the stuffing box. In many cases, these pumps are in environments where change-out of the seal rings is difficult and results in costly downtime.

SUMMARY OF THE INVENTION

In a preferred embodiment of the present invention, there is provided a packing assembly for use in sealing around the wash pipe of a drilling swivel, the packing assembly including a housing forming a sealing assembly chamber and a sealing assembly disposed in the chamber. The sealing assembly is comprised of at least one annular seal ring which sealingly engages the wash pipe. A containment member which is axially spaced from the seal ring and an injectable packing positioned between the seal ring and the containment member and sealingly engaging the wash pipe. An injection port or the like is provided to permit injection of the injectable packing into the chamber between the seal ring and the containment member.

In another preferred embodiment of the present invention, there is provided a packing assembly for use with a pump having a rotating shaft comprising a housing assembly forming an annular sealing assembly chamber in surrounding relationship to a pump shaft, the housing assembly having an injection port in open communication with the chamber. A sealing assembly is disposed in the chamber and includes a first annular lip seal surrounding and in sealing engagement with the shaft, a second annular lip seal surrounding and in sealing engagement with the shaft, the first and second annular seal rings being axially spaced. An injectable packing composition is in sealing engagement with the shaft and is disposed between the first and second axially spaced seal rings.

DETAILED DESCRIPTION OF PREFERRED EMBODIMENTS

Figure 1:
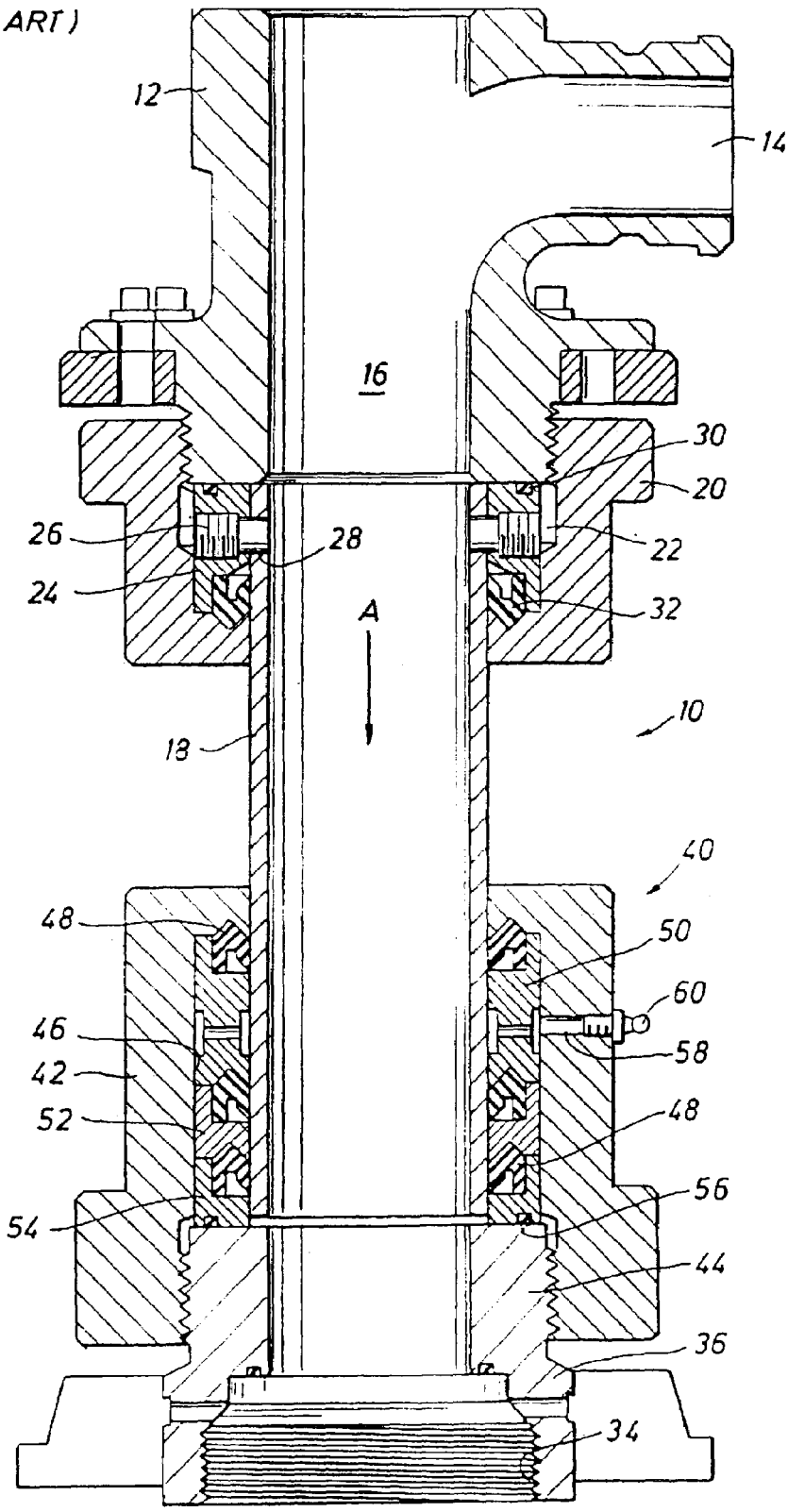
FIG. 1 (PRIOR ART)
FIG. 1 is an elevational view, partly in sections, showing a prior art packing assembly used in a rotary drilling swivel.

Referring, first, to FIG. 1, there is shown a rotary drilling swivel with a conventional, prior art packing assembly. The swivel assembly, shown generally as (10), is shown in simplified form, drilling swivels of the type under consideration being well known to those skilled in the art. The swivel (10) includes a goose neck head (12) having an inlet (14) connected to a source of drilling fluid (not shown). Inlet (14) is in communication with a flow passage (16) which, in turn, is in open communication with a wash pipe (18), through which drilling fluid flows in the direction shown by arrow A. Threadedly connected to goose neck head (12) is gland (20). Gland (20) defines a chamber (22) in which is received a collar (24) in surrounding relationship to wash pipe (18). A series of set screws (26) received in threaded bores in collar (24) engage bores (28) in wash pipe (18) whereby wash pipe (18) is fixedly connected to and remains stationary with goose neck head (12). An O-ring seal (30) provides fluid tight sealing between collar (24) and goose neck head (12) while a lip type seal (32) insures fluid tight sealing between wash pipe (18) and collar (24).

Wash pipe (18) is in open communication with a threaded opening (34) in a rotating head (36) being part of a top drive assembly well known to those skilled in the art as shown, for example, in U.S. Pat. No. 4,449,596, incorporated herein by reference for all purposes.

A rotating packing assembly, shown generally as (40) includes a threaded gland (42) received on the neck portion (44) of rotating head (36). Gland (42) forms an annular sealing assembly chamber (46) in surrounding relationship to wash pipe (18). As is conventional in these prior art packing assemblies, there are a series of axially spaced annular lip seals (48) which in conjunction with metal adapter rings (50, 52 and 54) maintain seal rings (48) in sealing engagement with wash pipe (18) as packing assembly (40) rotates around wash pipe (18). An O-ring seal (56) provide static sealing between metal adapter (54) and the neck (44) of rotating head (36). As is also conventional in prior art packing assemblies such as packing assembly (40), there is a port (58) through the wall of gland (42) which is provided with a button head fitting (60) which permits a lubricant to be injected into chamber (46).

Figure 2:
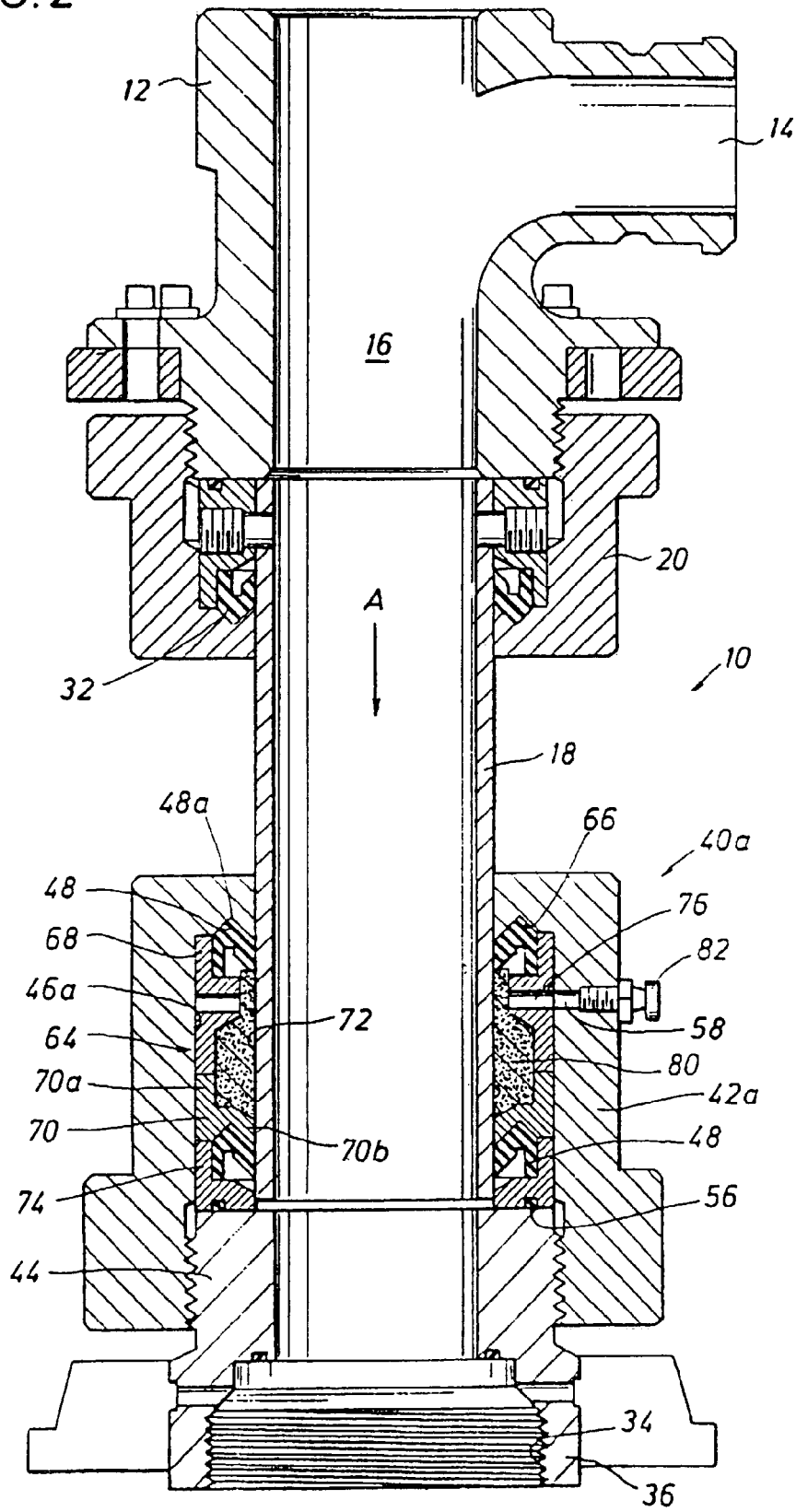
FIG. 2 is a figure similar to FIG. 1 showing one embodiment of the packing assembly according to the present invention.

Referring now to FIG. 2, there is shown one embodiment of the packing assembly of the present invention. Save for the construction of the packing assembly, described hereafter, the embodiment shown in FIG. 2 is essentially the same as that shown in FIG. 1. Packing assembly (40*a*) includes a sealing assembly shown generally as (64) which is disposed in a chamber (46*a*) formed by gland (42*a*). Sealing assembly (64) includes a first lip type seal ring (48) having an axially extending portion (48*a*) received in an annular recess (66) formed in gland (42*a*), seal (48) being in sealing engagement with wash pipe (18). Seal ring (48) is held in position by a generally L-shaped annular metal adapter (68) which essentially forms an annular pocket in which is received seal ring (48). A second metal adapter ring (70), in cooperation with metal adapter ring (68), forms an annulus (72) around wash pipe (18). Adapter ring (70) includes an annular axially projection flange portion (70*a*) and an annular radially inwardly projecting lip (70*b*). Metal adapter (70) in cooperation with another metal adapter (74) cooperate to form a pocket for a second type seal ring (48) which is in sealing engagement with wash pipe (18), seal ring (48) engaging one side of lip (70*b*). Injection port (58) in gland (42*a*) is in register with a port (76) in metal adapter ring (68) which in turn opens into annulus (72). Disposed in annulus (72) is an injectable packing (80) described more fully hereafter, injectable packing (80) being introduced into annulus (72) via injector head (82) received in bore (58). As can be seen, the injectable packing (80) fills annulus (72) and because of its malleable nature, forms a seal between wash pipe (18) and adapter rings (70) and (68). Additionally, as can be seen, a portion of injectable packing (80) engages the uppermost seal ring (48). Further, because of its malleable nature, packing (80) will also flow past lip (70*b*) to engage seal ring (48) which engages lip (70*b*).

Figure 3:
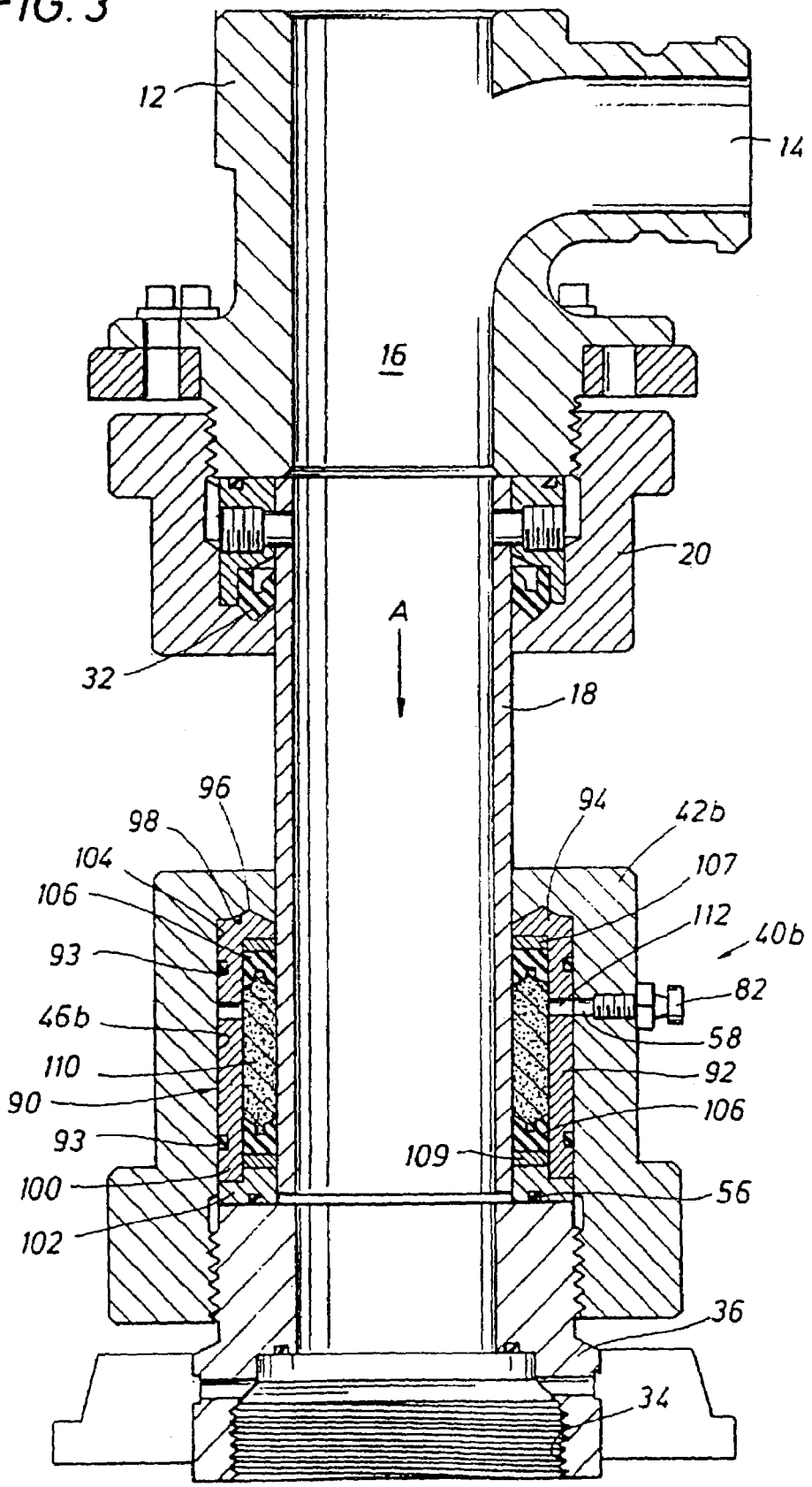
FIG. 3 is a view similar to FIG. 1 showing another embodiment of the packing assembly of the present invention.

Referring to FIG. 3, there is shown yet another embodiment of the packing assembly of the present invention. Packing assembly (40*b*) differs from packing assembly (46*a*) in that the sealing assembly, shown generally as (90), is of the cartridge type. A gland (42*b*) secured to head (36) forms a sealing assembly chamber (46*b*). Sealing assembly (90), received in chamber (46*b*), includes a casing formed by cylindrical wall portion (92) from which projects radially inwardly, an annular flange (94). Sealing between cylindrical wall (92) and gland (42*b*) is accomplished by means of O-rings (93). As can be seen, flange (94) has an axial projection (96) which nests in recess (98) in gland (42*a*). The end (100) of the casing distal flange (94) engages metal adapter ring (102), cylindrical wall (92) and flange (94) serving to form an annulus (104) between wash pipe (18) and cylindrical wall (92). Disposed in the annulus (104) are first and second type chevron type seal rings (106), rings (106) being axially spaced as shown, one of the chevron rings (106) engaging a backup ring (107) which in turn engages flange (94), the other of the chevron ring (106) engaging a backup ring (109) which engages metal adapter (102). The annular, axially extending space between the chevron rings (106) is filled with an injectable packing (110) which can be introduced via injection assembly (82) and port (58), there being a registering port (112) in cylindrical wall (92). It will be appreciated that chevron rings (106) are in sealing engagement with wash pipe (18) and cylindrical wall (92), injectable packing (110) likewise being in sealing engagement with wash pipe (18) and cylindrical wall (92). Additionally, and because of the malleable nature of injectable packing (110), the radially inner and radially outermost lips of the chevron seal rings (106) will effectively be pressure energized by injectable packing (110) enhancing their sealing effectiveness.

Figure 4:
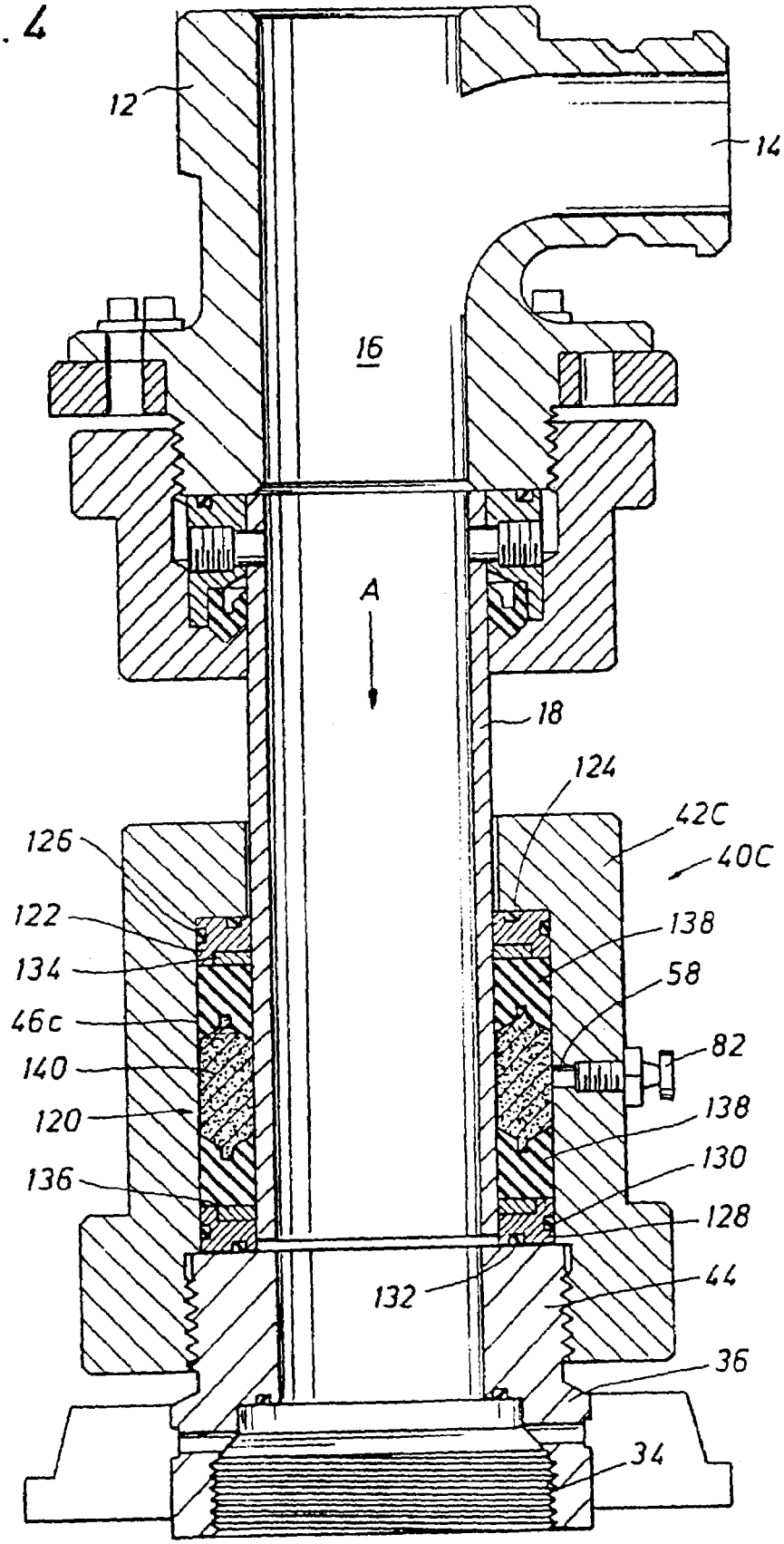
FIG. 4 is a view similar to FIG. 1 showing another embodiment of the packing assembly of the present invention.

Turning now to FIG. 4, there is shown another embodiment of the packing assembly of the present invention. Packing assembly (40*c*) includes a gland (42*c*) forming an annular chamber (46*c*) in surrounding relationship to wash pipe (18). Disposed in chamber (46*c*) is a sealing assembly shown generally as (120). Sealing assembly (120) includes an upper, metal adapter ring (122) which engages the end wall of gland (42*c*), sealing between metal adapter (122) and gland (42*c*) being affected by O-rings (124) and (126). In like fashion, a second metal adapter ring (128) is axially displaced from metal adapter (122) and is sealed against gland (42*c*) and the neck (44) of rotating head (36) by means of seal rings (130) and (132), respectively. A first backup or anti-extrusion ring (134) engages metal adapter (126) while a second backup or anti-extrusion ring (136) engages metal adapter ring (128). First and second axially spaced chevron type seal rings (138) are received in chamber (46*c*), one of the chevron type seal rings (138) engaging in the anti-extrusion ring (134), the other of the chevron type seal rings (138) engaging in extrusion ring (136). The annular, axially extending space between the chevron rings (138) is filled with injectable packing (140) introduced via injection assembly (82) and port (58). It can be seen that the chevron rings (138) as well as injectable packing (140) are in sealing engagement with wash pipe (18) as well as gland (42*c*). As is the case with the embodiments shown in FIG. 3, the injectable packing (140), because of its malleable nature, pressure energizes the chevron seals (138) forcing the radially innermost and radially outermost sealing lips into fluid tight engagement with the wash pipe (18) and gland (42*c*), respectively.

Figure 5:
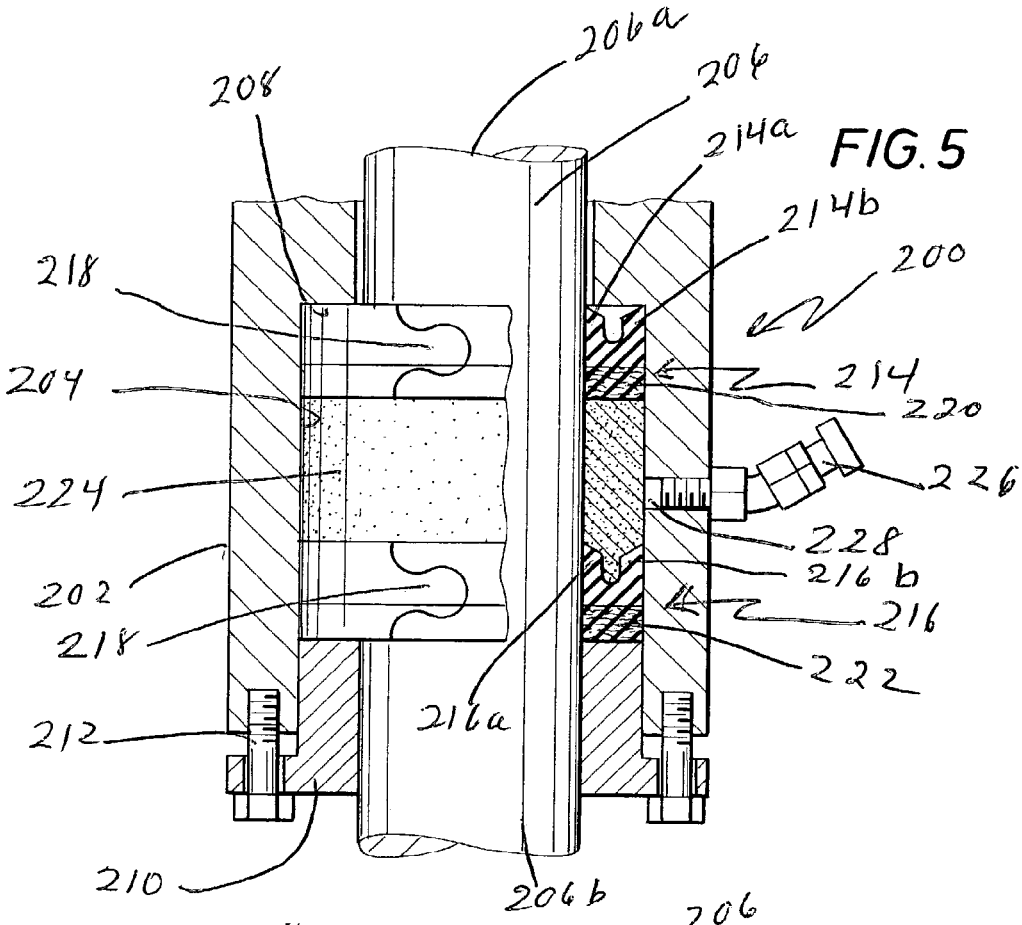
FIG. 5 is an elevational view, partly in section showing a stuffing box having a rotating shaft of a pump extending therethrough and a sealing assembly in accordance with the present invention.

Referring now to FIG. 5, there is shown a pump shaft/stuffing box assembly, indicated as 200, forming part of a pump assembly having a rotating shaft. A stuffing box 202 defines a cylindrical chamber 204 through which extends the rotating shaft 206 of a pump (not shown). The shaft 206 has a first end 206*a* that would be connected to the pump and a second end 206*b* that would be connected to a prime mover, e.g., a motor. The stuffing box 202 has a annularly extending, axially facing shoulder 208, partially defining chamber 204 and an adjustable packing gland 210 also at least partially defining chamber 204. The packing gland 210 is secured to stuffing box 202 by means of bolts 212 that can be adjusted to force packing gland 210 axially towards annular shoulder 208.

Disposed in chamber 204 is a first, or upper annular lip seal shown generally as 214 and a lower, or second annular lip seal 216, seals 214 and 216 being axially spaced in chamber 204.

As shown, seals 214 and 216 are of the split ring variety, the rings being connectible by means of a tongue and groove arrangement 218. It will appreciated that seal rings that are solid annular bodies can be used as well as the split ring variety shown in FIG. 5. Seal rings 214 and 216 are of the chevron type having radially inner and outer lips. Thus, seal 214 has radially inner lip 214*a* and radially outer lip 214*b*, while seal 216 has radially inner lip 216*a* and radially outer lip 216*b*. The radially inner lips 214*a* and 216*a* are in sealing engagement with shaft 206, while the radially outer lips 214*b* and 216*b* are in engagement with the cylindrical wall 204 of stuffing box 202. Seal 214 has a heel portion 220, while seal 216 has a heel portion 222. Heel portions 220 and 222 are reinforcements to prevent extrusion of the softer material forming the sealing lips. The heel portions 220 and 222, which as noted serve as anti-extrusion elements, can be comprised of a braided construction of various fibrous or strands of material that can include, but are not limited to, nylon, polyester, aramids, cellulosics, acrylics, glass, carbon and the like, and can be thermoplastic or thermo-setting in nature. The braids can also include metallic wire or supports if desired. Generally speaking, these braided material are impregnated with elastomeric or resinous binders between the strands, the binders being either thermoplastic or thermo-setting in nature, the heel portions being bonded to the remaining portion of the seal forming the sealing lips. The reinforcing or anti-extrusion sections (heels) can also be of layered fabric design whereupon laminates of any number of fabrics can be bonded together with a thermosetting or thermoplastic material to form the reinforcing or anti-extrusion section that is then bonded to the remainder of the seal forming the sealing lips. The use of lips seals with reinforcing or anti-extrusion sections is particular desirable when the pump is being used to handle liquids containing abrasives or other solid materials.

The annular, axially extending space between seal rings 214 and 216 is filled with an injectable packing 224 that can be introduced via an injection assembly 226 that is fitted into an opening 228 through the wall of stuffing box 202, the injectable packing filling the anular groove formed between lips 216*a* and 216*b*.

Figure 6:
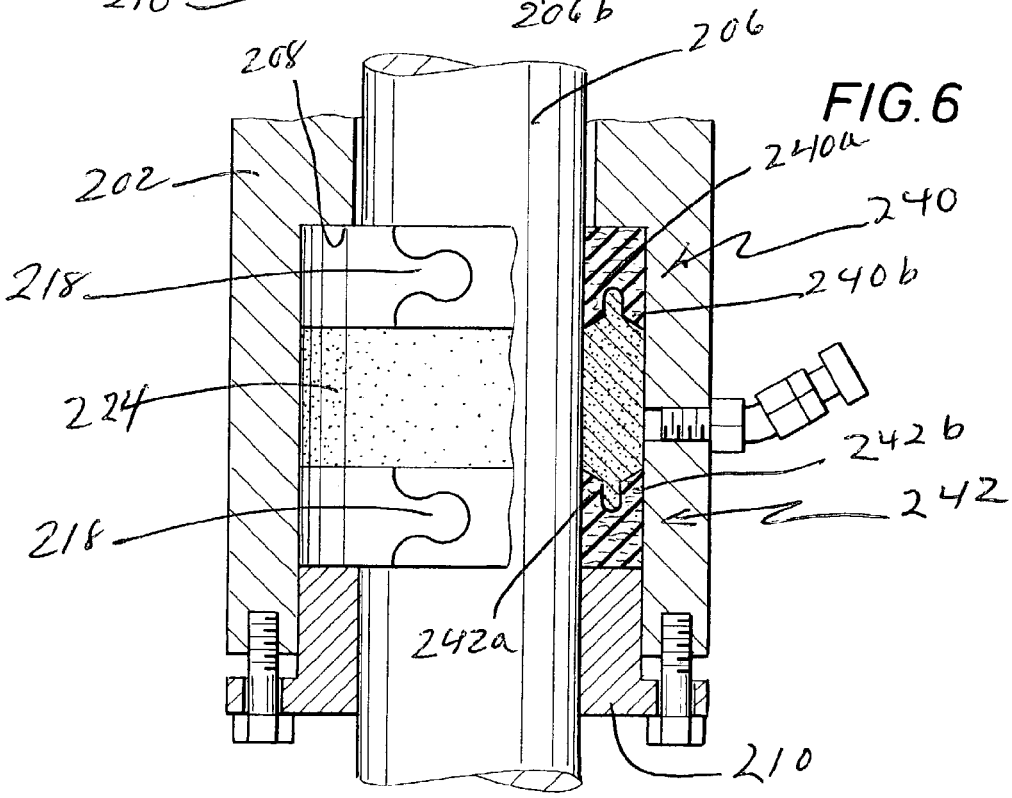
FIG. 6 is a view similar to FIG. 5 showing another embodiment of the present invention.

Referring now to FIG. 6, there is shown a pump shaft/stuffing box assembly that differs slightly from that shown in FIG. 5. More specifically, the upper seal ring, shown as 240, is generally of homogenous construction and is made from any one of a variety of resilient materials commonly used in making lip seals, gaskets or the like. In like manner, lower seal 242 is also of homogenous construction. Additionally, it can be seen that, unlike the embodiment shown in FIG. 5, the lips 240*a* and 240*b* of lip seal 240 are contiguous the injectable packing 224 and the lips 242*a* and 242*b* are likewise contiguous injectable packing 224. The heel portion 244 of lip seal 240 engages the annular shoulder 208 while the heel portion 246 of seal 242 engages packing gland 210. Since the sealing lips of seals 240 and 242 face each other and since, as is typical with chevron or other dual lip seal rings, there is an annular groove formed between the lips, the injectable packing 224 can pressure energize the sealing lips 240*a*, 240*b*, 242*a*, 242*b*. The embodiment shown in FIG. 6 is particularly useful when the pump is handling fluids that are clean, i.e., free of abrasives or other solids and is also more desirable for very high pressure operations.

The lip seal shown in FIGS. 5 and 6 can be constructed from a wide variety of materials. Thus, the portion of the seal that forms the lips can be of elastomeric or resinous type material such as, but not limited to, nitrites, neoprene, styrene- butadine rubber, fluroelastomers, polyurethanes, natural rubber, and the like. Combinations of these materials may be used and reinforcement materials may be used including, but not limited to, fiberglass, aramids, polyamides, acrylics, glass, cellulosics, carbon fibers and the like.

The injectable packing employed in the packing/sealing assemblies of the present invention is of a type that is malleable and has a putty like consistency, meaning that it is injectable or pumpable in the sense that it can be forced via a hydraulically activated injection gun or the like into a space between two relatively movable members, and, when in the space can conform to the surfaces forming the space to effect fluid type sealing between the two relatively movable members. Such injectable packings generally have at least two main components: a carrier and a filler. Generally speaking, the carrier comprises greases, oil and other such viscous lubricants while the filler can include a wide variety of synthetic and natural materials which can be in the form of fibers, flocks, particles or the like. Such fillers can include, without limitation, glass fibers, carbon fibers, aramid fibers, polybenzimidazole fibers, boron fibers, graphite fibers, PTFE particles, etc. In general, the filler should be of a material which is non-abrasive so as to prevent any wearing or galling of moving parts which contact the injectable packing. The injectable packing employed in the packing assemblies of the present invention can be tailored to meet various pressure and temperature applications. For example, an injectable packing suitable for use in the present invention can be blend of exfoliated graphite particles and high temperature sacrificial lubricants. A suitable injectable packing for use in the packing assembly of the present invention is marketed under the trademark UPAK ® 2000ES by Utex Industries, Inc. As noted above, these injectable packings can be injected into the packing assembly by way of a hydraulically operated injection gun or the like. The injectable packings of the present invention remain malleable indefinitely and, accordingly, additional injectable packing can be added to the packing/sealing assemblies of the present invention as wear occurs. Because the injectable packings are of such a highly viscous nature, they do not easily extrude past packing rings such as the type noted above and conventionally used in packing/sealing assemblies of the type under consideration.

Ideally, the injectable packing is pressured up to a pressure which, is more or less the same as the pressure of the drilling fluid or the fluid being handled by the pump, meaning that the seal rings are in a substantially balanced pressure state. Accordingly, the packing rings are subjected to less work and exhibit longer life than do conventional packing rings. Preferably, the injectable packings of the present invention would generally be of a type that possess high thermal conductivity, to aid in heat dissipation which again enhances the working life of the seal rings.

While, in one aspect, the invention has been described above with respect to a rotary drilling swivel in which the wash pipe is stationary and the packing assembly is rotating, it is to be understood that the packing assembly is applicable to those cases wherein the wash pipe is rotating and the packing assembly is stationary.

The invention claimed is:

1. In combination with a rotary drilling swivel having a cylindrical wash pipe, a packing assembly comprising:

a housing assembly forming an annular closed, sealing assembly chamber in surrounding relationship to said wash pipe, said housing assembly including a gland portion having an injection port in open communication with said chamber;

a sealing assembly disposed in said chamber, said sealing assembly including:

a first, annular seal ring having an elastomeric, first annular radially inwardly projecting sealing lip, said sealing lip surrounding and being in sealing engagement with said wash pipe;

an annular containment member disposed in said chamber in surrounding relationship to said wash pipe and axially spaced from said first seal ring; and an injectable packing composition in sealing engagement with said wash pipe and disposed between said first seal ring and said containment member; one of said wash pipe and said packing assembly being rotatable relative to the other.

2. The packing assembly of claim 1 wherein said containment member comprises a second annular seal ring having an elastomeric, first annular radially inwardly projecting sealing lip, said sealing lip in sealing engagement with said wash pipe.

3. The packing assembly of claim 1 wherein said containment member comprises a portion of a metal adapter ring, said adapter ring having an annularly extending, axially projecting flange and an annularly extending, radially inwardly projecting lip.

4. The packing assembly of claim 3 further including a second annular seal ring having an elastomeric, first annular radially inwardly projecting sealing lip, said sealing lip being in sealing engagement with said wash pipe, said lip on said adapter ring having a first, axially facing side and a second, axially facing side, said second seal being in engagement with said second side, said injectable packing engaging said first side.

5. The packing assembly of claim 2 wherein said sealing assembly comprises a cartridge, said cartridge comprising a casing having a cylindrical wall and an annularly extending radially inwardly projecting flange, said flange defining a generally circular opening said first and second seals being received in said cartridge, said injectable packing being disposed between said first and second seals.

6. The packing assembly of claim 2 wherein said seal rings are in sealing engagement with said wash pipe and said gland.

7. The packing assembly of claim 6 wherein said injectable packing is received between and in engagement with said first and second seal rings.

* * * * *